US006644652B1

(12) United States Patent
Walsh et al.

(10) Patent No.: US 6,644,652 B1
(45) Date of Patent: Nov. 11, 2003

(54) MOTION CONTROL FOR SHEETS IN A DUPLEX LOOP OF A PRINTING APPARATUS

(75) Inventors: Martin R. Walsh, St. Albans (GB); Annmarie Brinsley, Stevenage (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/134,274

(22) Filed: Apr. 26, 2002

(51) Int. Cl.[7] ..... B65H 29/00

(52) U.S. Cl. ..... 271/186; 271/176; 271/65; 271/291; 271/270; 271/182

(58) Field of Search ..... 271/176, 186, 271/65, 291, 270, 182; 399/16, 401, 396

(56) References Cited

U.S. PATENT DOCUMENTS 4,990,965 A * 2/1991 Kiya ..... 399/402
5,003,355 A * 3/1991 Tanzawa ..... 399/401
5,060,025 A * 10/1991 Kummel et al. ..... 399/401
5,086,319 A * 2/1992 Carolan ..... 399/396
5,197,726 A * 3/1993 Nogami ..... 271/110
5,337,135 A * 8/1994 Malachowski et al. ..... 399/401
5,461,468 A * 10/1995 Dempsey et al. ..... 399/396
5,467,182 A * 11/1995 Hower et al. ..... 399/364
5,504,568 A 4/1996 Saraswat et al. ..... 355/308
5,999,758 A * 12/1999 Rai et al. ..... 399/16
6,199,858 B1 3/2001 Wyer ..... 271/186
6,322,069 B1 11/2001 Krucinski et al. ..... 271/265.02
6,550,762 B2 * 4/2003 Stoll ..... 271/186
2003/0057639 A1 * 3/2003 Chapman et al. ..... 271/270

* cited by examiner

*Primary Examiner*—Donald P. Walsh
*Assistant Examiner*—Matthew J Kohney
(74) *Attorney, Agent, or Firm*—R. Hutter

(57) ABSTRACT

In a printing apparatus capable of producing duplex, or two-sided, prints, print sheets which have received a first-side image move to an inverter and a duplex loop which re-feeds the sheet to receive the second-side image. The sheets move through the duplex loop at different speed than through the main path where images are placed. A control system controls the time in which a change in speed of a sheet in the duplex loop is initiated. The control system takes into account a desired amount of buckle experienced by the sheet, which is useful in de-skewing the sheet before receiving an image.

8 Claims, 2 Drawing Sheets

MOTION CONTROL FOR SHEETS IN A DUPLEX LOOP OF A PRINTING APPARATUS

TECHNICAL FIELD

The present invention relates to controlling the motion of sheets moving through a printing apparatus, where the apparatus is capable of "duplexing," or printing on both sides of a sheet.

BACKGROUND

On-demand page printers, wherein images are created in response to digital image data submitted to the printing apparatus, are familiar in many offices. Such printers create images on sheets typically using electrostatographic or ink-jet printing techniques.

Particularly with sophisticated printing apparatus, it may often be desired to print "duplex" prints, that is prints having images on both sides of the sheet. In order to obtain duplex prints, it is common to provide a "duplex loop" or "inverter" within the printing apparatus. The purpose of an inverter is to handle a sheet after one side thereof has received an image, and in effect turn the sheet over; a duplex loop re-feeds the sheet to the image-making portion of the printing apparatus so that the individual sheet becomes available to the image-making portion twice, once for each side.

DESCRIPTION OF THE PRIOR ART

U.S. Pat. No. 5,504,568 discloses a duplex loop in a xerographic printing apparatus; the patent is generally directed toward scheduling the printing of first and second side images on each sheet.

U.S. Pat. No. 6,199,858 discloses an office printer in which sheets being readied for re-feeding to the marking station for duplexing are shingled along a duplex path.

U.S. Pat. No. 6,322,069 discloses a control system for governing the distance between sheets in a xerographic printer capable of duplexing.

SUMMARY OF THE INVENTION

According to the present invention, there is provided, in a printing apparatus having a marking station operatively disposed along a path, an inverter downstream of the marking station along the path, a duplex loop connecting the inverter to a location upstream of the marking station along the path, and a duplex sensor disposed at a predetermined location along the duplex loop for detecting a sheet, a method for controlling motion of a sheet in the apparatus. A sheet moves through the path at a process velocity and moves through a portion of the duplex loop at a duplex velocity. An error of a sheet arriving at the duplex sensor relative to a predetermined arrival time is determined. Based on at least the error, a time for initiating a change in velocity of the sheet from the duplex velocity to the process velocity is calculated.

DETAILED DESCRIPTION

Figure 1:
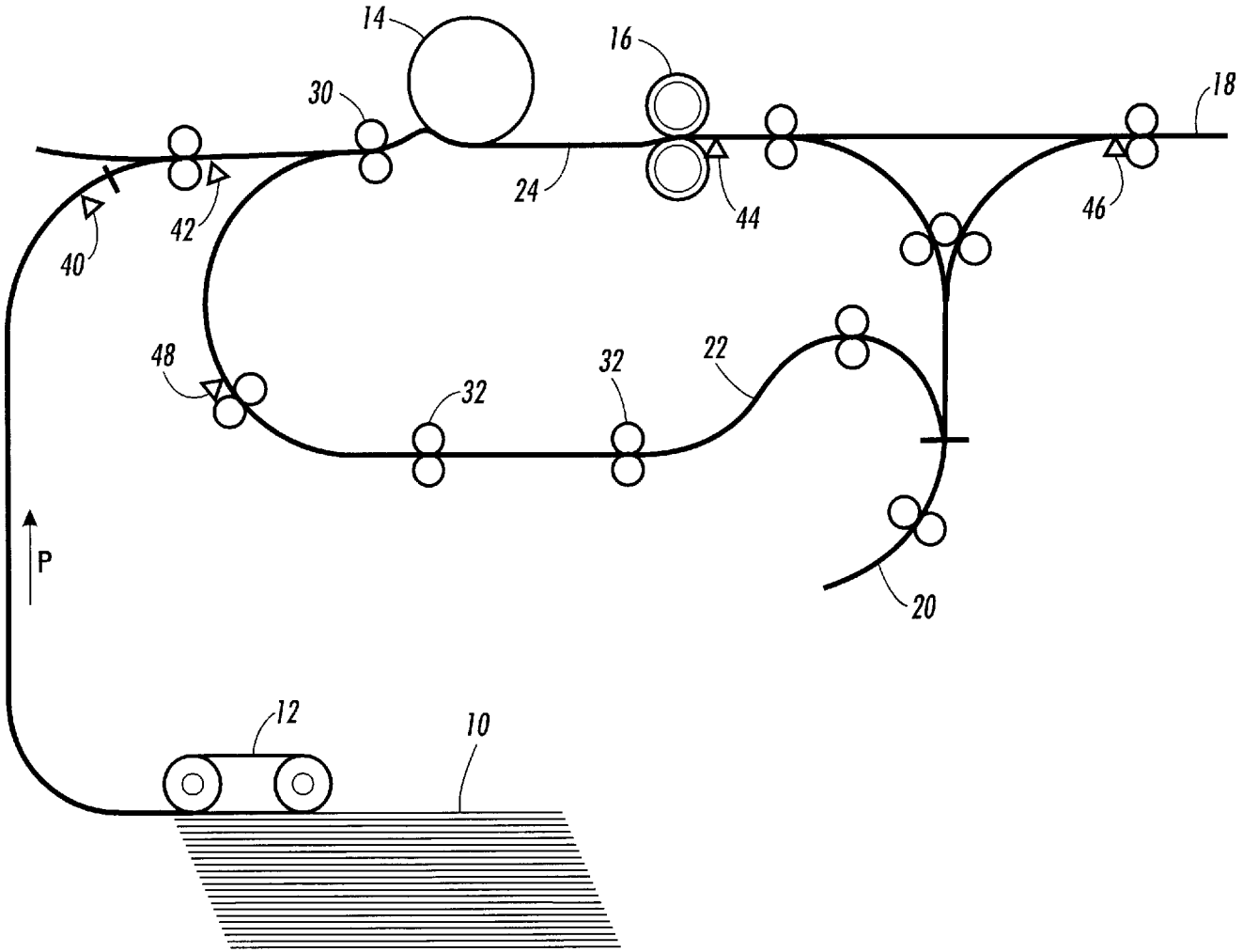
FIG. 1 is a simplified elevational view of a duplexing paper path as would be found in a digital printer or copier.

FIG. 1 is a simplified elevational view of a duplexing paper path as would be found, for example, in a digital printer or copier. In the embodiment, sheets on which images are to printed are drawn from a supply stack 10 by a feed mechanism 12 and caused to move, through process direction P, toward what can be generally called a "marking station" 14 (in the illustrated embodiment, the marking station 14 includes a xerographic photoreceptor, but in other cases could include, for example, an intermediate transfer member and/or an ink-jet printing device). Also, in a xerographic embodiment, there is, downstream of marking station 14, a fuser 16. As illustrated, the marking station 14 places a predetermined image on the upward-facing side of a sheet passing past it.

In the case of printing a "simplex" sheet, meaning a sheet having an image on only one side thereof, the sheet is sent directly from marking station 14 through fuser 16 to an exit 18 (which may be directed to, for instance, a catch tray or other finishing device, such as a stapler). When it is desired to print a duplex or two-side-imaged sheet, the sheet, must be inverted and re-fed to the marking station following receiving a first image on the first side thereof, so that the marking station can place the second-side image.

To perform such inverting and re-feeding, it is common to provide what is here called an inverter, indicated as 20, and a duplex loop, indicated as 22. The inverter is a length of sheet path into which a sheet enters, and then exits in a reverse direction of motion. The duplex loop 22 conveys the sheet back to the marking station 14; as the sheet was in effect turned over by the action of inverter 20, the side of the sheet which had not received the initial image will now be face-up to receive the second-side image at the marking station 14. Following printing of the second-side image, the now "duplexed" sheet is conveyed to exit 18.

Certain practical considerations will be apparent. First, the creation of images by marking station 14 must be coordinated precisely with the position and velocity of the sheets passing through the duplex loop. Secondly, because a number of sheets pass through the apparatus in succession, a control system must coordinate the motions of multiple sheets in the system. Further, in one embodiment of a duplexing system, the velocity of the sheet moving through the duplex loop 22 is significantly greater (two to three times) than the velocity of sheets through the rest of the sheet path (which is here called "main path" 24), so a sheet moving in duplex path 22 must be deliberately slowed down before it can receive a second-side image at marking station 14.

A control system for operating the system of FIG. 1 will use various devices to move sheets through the system (such as powered rollers, etc.) and to detect the position of sheets in the system over time (such as optical or mechanical sensors). With particular relevance to the present description, there is provided a registration nip 30, formed by two rolls, which cause a sheet to move through marking station 14 at what is here called a "process velocity"; and a duplex loop drive system 32, by which any number of roller pairs along duplex loop 22 push a sheet through the loop at what is here called a "duplex velocity." As for sensors, there are provided a wait station sensor 40, which detects sheets coming from the supply stack 10; a registration sensor 42, upstream of the registration nip 30; a post-fuser sensor 44; and an exit sensor 46. Also, there is a duplex sensor 48 at a predetermined location along the duplex loop 22.

The control method basically operates as follows. A sheet in inverter 20, having received a first-side image, remains in inverter 20 until a fixed time elapses from when the sheet originally entered the inverter. The sheet is then fed, such as by drive system 32, at a relatively high duplex velocity until the lead edge thereof is detected by duplex sensor 48. At a fixed time after the sheet has triggered the duplex sensor 48, the sheet is ramped down from the duplex velocity to near or at the marking velocity for sheets along main path 24 by the time the lead edge reaches the registration nip 30. The control system controls the precise time at which the "ramp-down" of the sheet from the duplex velocity to the process velocity begins.

When the sheet arrives at the registration nip, the rolls forming the nip are held stationary, so that when the lead edge contacts the nip, the sheet buckles and de-skewing occurs. A "buckle setting" is a software datum which can be chosen as the amount of time after the lead edge makes the duplex sensor that the registration nip is unlocked (or, in other words, selectably released, such as by a control system) and in this embodiment starts to push the sheet toward the marking station; briefly, the longer the time, the more buckle is created upstream of the registration nip 30.

Figure 2:
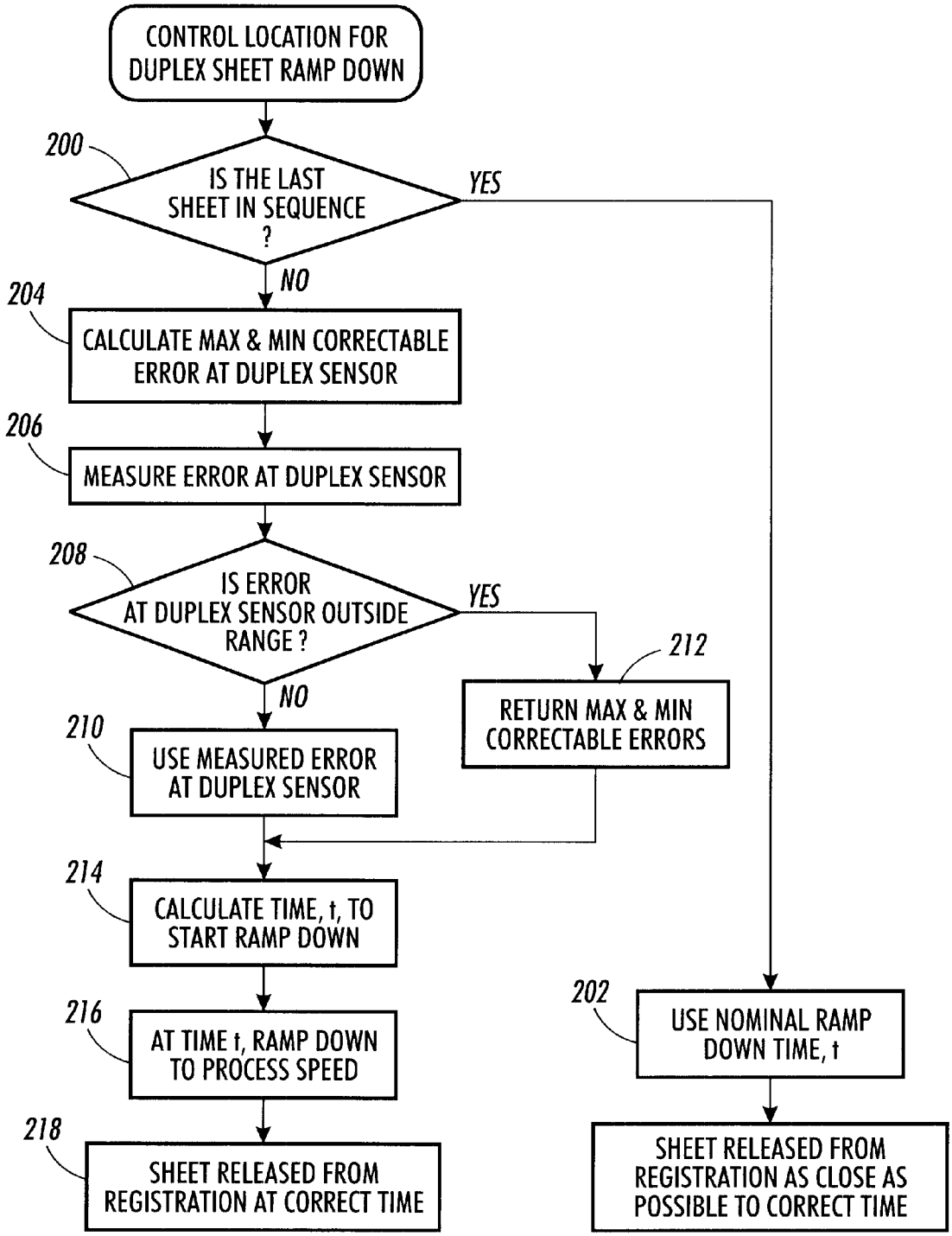
FIG. 2 is a flowchart showing control steps according to one embodiment of the present invention.

FIG. 2 is a flowchart showing control steps according to one embodiment of the present invention, as would be carried out by a control system governing the various electromechanical devices associated with the paper path of FIG. 1. The parameter that is ultimately controlled by the illustrated method is the start time at which a sheet moving through duplex loop 22 is slowed down from a relatively high duplex velocity to the process velocity; in this example, it is assumed that the time required once ramp-down is initiated for the sheet to go from the duplex velocity to the process velocity (the "ramp time") is fixed. Certain other parameters useful to the method are calculated incidental to the basic method shown in the Figure.

First, it is determined, such as from an imaging scheduling algorithm, whether a particular sheet passing through the duplex loop 22 is the last sheet in a sequence (step 200); if it is, then the bulk of the method steps can be skipped and the ramp-down initiated at a nominally-scheduled time (step 202).

If the sheet in question is not the last sheet in sequence, then the careful scheduling of the ramp-down initiation must be carried out. First, a maximum practical value and minimum practical value of the error for when the lead edge of a sheet passes duplex sensor 48 are calculated; these values relate to the physical limitations of how early or how late the ramp-down can start as a sheet is being fed through the duplex loop 22. The calculation is as follows:

minimum error=(nominal ramp-down initiation time*(duplex velocity−process velocity))/process velocity maximum error=((duplex velocity−process velocity)*(buckle setting−ramp time−page sync−nominal ramp-down initiation time))/duplex velocity Of the above parameters, duplex velocity, process velocity, ramp time, and the nominal ramp-down initiation time are known in advance. The "buckle setting," described above, may depend on other control considerations, which will be described below. Page sync is a signal sent at a predetermined time (the value of page sync relates to the time of the activation) before the registration nip 30 acts to pass a sheet therethrough at process velocity, to ensure the image on the charge receptor is correctly aligned with the paper.

When the lead edge of a sheet in duplex loop 22 is detected at duplex sensor 48, its error, meaning its arrival time relative to some predetermined nominal value ("error at duplex sensor"), is measured (step 206). As can be seen in steps 208–212, if the error is outside the minimum or maximum range of errors, then a substitute error value (the minimum calculated error if the error is too small, or the maximum calculated error if the error is too large) is entered into the subsequent algorithm; otherwise, the directly-measured error is used. The error value at the duplex sensor (whether the actual measured value, or the calculated maximum or minimum) is then used to calculate the time to initiate ramp-down, and the initiation time is calculated as follows, at step 214:

ramp-down initiation time=((error at duplex sensor)*process velocity/(duplex velocity−process velocity))+nominal ramp-down initiation time Once the ramp-down initiation time is calculated, the electromechanical devices along duplex loop 22 are controlled to initiate the ramp-down at the calculated time (step 216). This results in the lead edge of the sheet reaching the registration nip 30 at a time suitable for its proper release to marking station 14 (step 218).

Returning to the concept of the "buckle setting" as described above, the buckle setting, which affects the amount of buckle experienced by a sheet contacting registration nip 30 before the rollers allow the sheet to move further, is a parameter in some of the calculations above. A nominal "buckle setting" is entered deliberately into the control system to obtain a desired amount of buckle, such as to obtain some deskewing, but in this embodiment the actual duplex buckle can be calculated:

duplex buckle=actual buckle setting−error at duplex sensor

The error at the duplex sensor is calculated as:

error at duplex sensor=time arrived at duplex sensor−expected time at duplex sensor the expected time at duplex sensor is calculated thus:

expected time at duplex sensor=pitch−actual duplex buckle setting where the pitch is a fixed number based on the known size of the sheet being fed, and the actual duplex buckle setting is set by a user to obtain a desired extent of de-skew at the registration nip 30.

If it is necessary to make an allowance for any changes to the buckle setting, the following algorithm can be used:

delay=predetermined fixed time−paper size+nominal buckle setting−actual buckle setting If the buckle setting is changed then the error at the duplex sensor will be changed by this amount and this reduces the latitude to correct errors. The algorithm changes the restart time by the amount of the buckle change ensuring that the sheet arrives at the duplex sensor as close as possible to the correct time.

In overview, the above series of calculations sets forth as a final goal the exact initiation time of a ramp-down from the duplex velocity to the process velocity. The inputs to the calculation include variables that remain fixed for an instance of a duplex operation, such as the ramp time, and the values for the process velocity and duplex velocity. One variable which will be changeable for each instance is the actual measured time at which a sheet in the duplex loop reaches the duplex sensor 48. Also taken into account is the desired amount of buckle before registration nip 30, which affects an amount of deskew.

The above-described method dynamically overcomes mechanical variations due to manufacturing tolerances among a population of machines. Among other advantages, the method allows the registration nip 30 to be locked for as long as possible during a duplex operation, which ensures that the trail edge of the previous sheet is clear of the transfer zone when the nip allows a sheet to pass therethrough to receive an image.

What is claimed is:

1. In a printing apparatus having a marking station operatively disposed along a path, an inverter downstream of the marking station along the path, a duplex loop connecting the inverter to a location upstream of the marking station along the path, and a duplex sensor disposed at a predetermined location along the duplex loop for detecting a lead edge of a sheet, a method for controlling motion of a sheet in the apparatus, comprising:

causing the sheet to move through the path at a process velocity;

causing the sheet to move through a portion of the duplex loop at a duplex velocity;

determining an error of the sheet arriving at the duplex sensor relative to a predetermined arrival time; and calculating, based on at least the error, a time for initiating a change in velocity of the sheet from the duplex velocity to the process velocity, the calculating step including determining if the error is outside a range, and if the error is outside the range, using a substitute error value instead of the determined error.

2. The method of claim 1, the duplex velocity being greater than the process velocity.

3. The method of claim 2, the duplex velocity being greater than twice the process velocity.

4. The method of claim 1, the substitute error being a minimum practical error.

5. The method of claim 1, the substitute error being a maximum practical error.

6. The method of claim 1, wherein the apparatus further comprises means for creating a buckle in a sheet, and the calculating step further comprising taking into account a variable relating to an amount of buckle in a sheet.

7. The method of claim 6, wherein the means for creating a buckle is disposed upstream of the marking station.

8. The method of claim 6, wherein the means for creating a buckle comprises a selectably-releasable registration nip.

* * * * *